United States Patent [19]

Uchida et al.

[11] Patent Number: 4,913,785

[45] Date of Patent: Apr. 3, 1990

[54] PROCESS FOR HOT-DIP METAL-COATING POORLY WETTABLE STEEL SHEETS

[75] Inventors: Yukio Uchida, Amagasaki; Yasunori Hattori, Izumisano; Yusuke Hirose, Osaka-Sayama; Nobuo Hatanaka; Nobuhiko Sakai, both of Amagasaki, all of Japan

[73] Assignee: Nisshin Steel Company, Ltd., Tokyo, Japan

[21] Appl. No.: 297,961

[22] Filed: Jan. 17, 1989

[51] Int. Cl.[4] ..... C25O 5/00

[52] U.S. Cl. ..... 204/38.5

[58] Field of Search ..... 204/28, 38.5, 44.5

[56] References Cited

U.S. PATENT DOCUMENTS 3,755,090 8/1973 Jackson ..... 204/38.5

*Primary Examiner*—T. M. Tufariello

*Attorney, Agent, or Firm*—Webb, Burden, Ziesenheim & Webb

[57] ABSTRACT

There is disclosed a process for preparing hot-dip metal coated steel sheets having excellent corrosion resistance comprising electrolytically plating steel sheets containing Si and/or Cr with an Fe-B alloy containing 0.001~0.3% by weight of B to the thickness of 0.05~5 g/m$^2$ and thereafter hot-dip-coating the thus pre-plated substrate sheets with a molten bath of Zn, Al or Zn-Al alloy. By this process poorly wettable steel sheets containing silicon and/or chromium can be well coated with zinc, aluminum and zinc-aluminum alloy.

7 Claims, 2 Drawing Sheets

PROCESS FOR HOT-DIP METAL-COATING POORLY WETTABLE STEEL SHEETS

FIELD OF THE INVENTION

Figure 1:
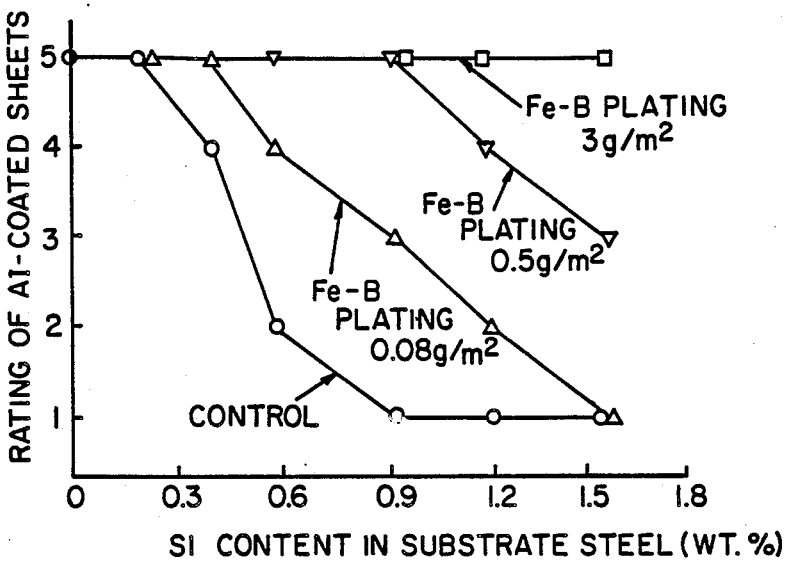

This invention relates to a process for preparing hot-dip metal-coated steel sheets which have excellent corrosion resistance and are suitable as materials for roofing and wall-facing and other building applications, construction of chemical plants, manufacturing internal combustion engine exhaust gas treatment apparatuses, etc.

BACKGROUND OF THE INVENTION

Recently, demand for steel materials having improved corrosion resistance suitable for use in building and construction of chemical plants has been growing because of increased acidification of the atmosphere, more active marine construction, etc. Also materials having improved corrosion reistance are wanted for use in manufacturing internal combustion engine exhaust gas treatment apparatuses, because the practice of spreading salts on roads in snowy districts to prevent freezing has led to a new corrosion problem.

For these purposes, hot-dip aluminum-coated steel sheets, hot-dip zinc-coated steel sheets and hot-dip zinc-aluminum-alloy-coated steel sheets are widely used at present. However, these materials are not satisfactory. Hot-dip aluminum-coated steel sheets are severely corroded at the spots where the aluminum coating layer has cracked by heavy working, although the flat parts have excellent corrosion resistance. Usually hot-dip aluminum-coated steel sheets are prepared by using a molten aluminum coating bath containing 5~13% by weight of silicon in order to inhibit growth of an alloyed layer which impairs workability of the coated sheets and their coating layer consists of a 2~3μ thick Al-Fe-Si ternary alloy layer and an Al-Si alloy coating layer. This ternary alloy layer is very hard and brittle and easily suffers cracking when the coated sheets are heavily worked. Stress concentrates at the cracked spots of the ternary alloy layer, which induces cracking of the outer coating layer. In the case of hot-dip aluminum-coated steel sheets, aluminum hardly exhibits sacrificial corrosion effect to for the steel substrate in the atmospheric corrosion environment and, therefore, the steel substrate is corroded at the locally-exposed spots formed by severe working.

In the case of hot-dip zinc-coated steel sheets or hot-dip Zn-Al-alloy-plated steel sheets, the steel substrate is also exposed when they undergo severe working and the Zn or Zn-Al-alloy coating layer cracks. In this case, the sacrificial corrosion effect of zinc is produced between the locally exposed steel substrate and the coating layer and thus the corrosion of the steel substrate is prevented to some extent. However, the Zn coating layer or the Zn-Al coating layer is corroded more rapidly in the vicinity of the exposed spots of the steel substrate than in the flat parts and thus eventually the corrosion of the steel substrate proceeds very rapidly.

Therefore, it is necessary to improve the corrosion resistance of the steel substrate per se in order to enhance corrosion resistance of the exposed parts of the steel substrate of these hot-dip metal-coated steel sheets. It is well known to add Si and Cr to steel singly or in combination in order to improve the corrosion resistance of substrate steel mateials. However, when steel substrates containing Si and/or Cr are hot-dip-coated with Zn, Al or a Zn-Al alloy by a continuous hot-dip coating line provided with a non-oxidizing pretreatment furnace (a Szendimir apparatus for instance), Si and/or Cr in the steel concentrates to the surface forming oxides during the annealing step preceding the coating in the continuous coating line and impairs the wettability of the substrate sheets, which results in occurrence of a plurality of dewetted (non-coated) spots, which become starting points of corrosion. Therefore, incorporation of these elements eventually deteriorates the corrosion resistance of the coated steel sheets.

In compensation for the defect caused by addition of these elements, it has been proposed to electrolytically plate the steel substrate containing Si and/or Cr with Ni before hot-dip metal coating in order to prevent the concentration of Si and/or Cr at the surface which occurs during the annealing step (JP-A-60-262950, 61-147865).

However, this pre-plating with Ni is not only expensive but the Ni tends to diffuse into the coating layer and deteriorate the corrosion resistance of the coating layer per se.

We carried out an extensive study for overcoming the defect of the prior art hot-dip coating, and have found that the occurrence of the dewetted (non-coated) spots is prevented by electrolytically plating substrate steel sheets with an Fe-B (iron-boron) alloy containing a small amount of B prior to the hot-dip metal coating, and thus hot-dip-coated steel sheets having excellent corrosion resistance can be produced.

SUMMARY OF THE INVENTION

This invention provides a process for preparing hot-dip-coated steel sheets having excellent corrosion resistance comprising electrolytically plating steel sheets containing Si and/or Cr with an Fe-B alloy containing 0.001~0.3% by weight of B to the thickness of of 0.05~5 g/m$^2$ and thereafter hot-dip metal-coating the thus pre-plated substrate sheets with Zn, Al or Zn-Al alloy.

The symbol "%" means weight percent hereinafter throughout the specification except when specificaly indicated otherwise.

In the present invention, the substrtate steel sheets may contain 2~30% Cr and/or 0.3~2.0% Si. Preferably, the substrate sheet steel contains 3~25% Cr, and preferably 0.5~1.8% Si.

The contents of C, Mn, P, S and Al need not be specifically restricted as long as they do not adversely affect the wettability with molten metal, although it is preferred that the contents of these impurity elements are: C≦0.10%, Mn≦2.0%, P≦0.05%, S≦0.05% and Al≦3%.

The substrate sheet steel may contain Ti, Nb, V, B, Mo and Cu, which are common additive elements well known in the art, in amounts usually employed.

The zinc bath used in the process of the present invention may contain the following impurities:

Up to 0.3% Al
Up to 0.5% Mg
Up to 0.3% Pb
Up to 0.2% Sb

The aluminum bath used in the process of the present invention may contain the following additive elements and impurities:

5~13% Si
Up to 2.5% Fe

The Zn-Al alloy bath used in the process of the present invention may contain:

2~65% Al, preferably 3.5~60% Al.

The Fe-B alloy layer formed in the process of the present invention contains preferably 0.005~0.2% B.

The electrolytic plating with Fe-B alloy can be carried out with a sulfate bath or chloride bath with the addition of one or more of boron compounds such as boric acid, metaboric acid, soluble metaboric acid salt, soluble tetraboric acid salt, and tetrafluoroboric acid salt at a pH of 1~3.

The hot-dip metal coating is known per se and is not specifically explained here.

The process of the present invention prevents occurrence of dewetted spots in the hot-dip metal coating and thus produces excellent hot-dip-aluminum-coated, hot-dip-zinc-coated or hot-dip-Zn-Al-alloy-coated steel sheets. The process can be applied to a wide spectrum of from carbon steels to high chromium stainless steels.

BRIEF EXPLANATION OF THE ATTACHED DRAWINGS

Figure 2:
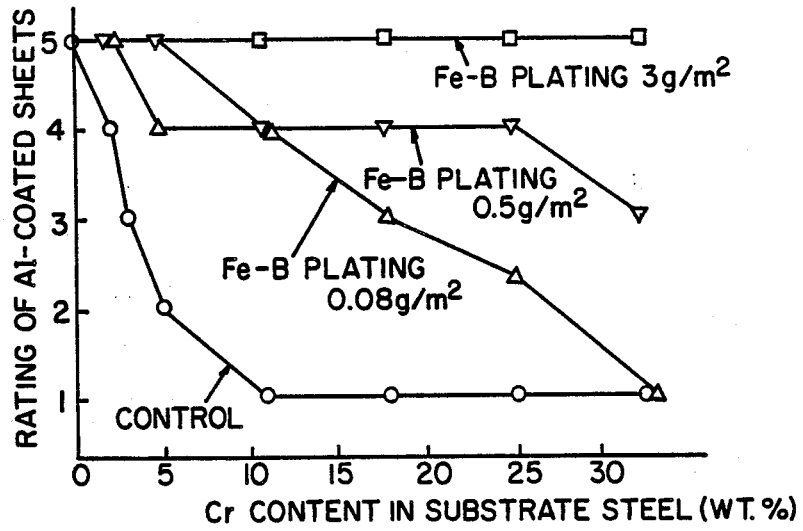
Figure 3:
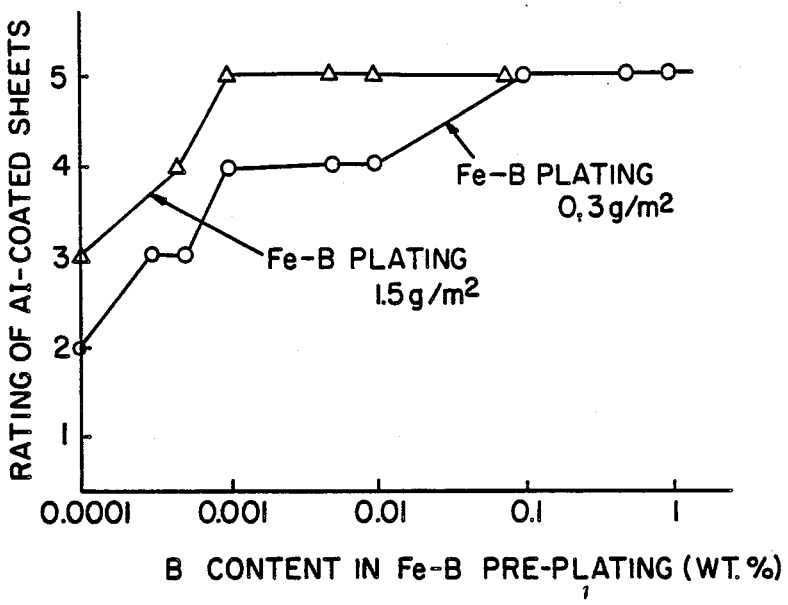

FIG. 1 is a graph showing the relation between the Si content in the substrate steel sheet and wettability with molten Al when the substrate sheets are pre-plated with Fe-B alloys or not pre-plated, FIG. 2 is a graph showing the relation between the Cr content in the substrate steel sheet and wettability with molten Al when the substrate sheets are pre-plated with Fe-B alloys or not pre-plated and FIG. 3 is a graph showing the relation between the B content in the Fe-B alloy for the pre-plating and the wettability with molten Al.

SPECIFIC DESCRIPTION OF THE INVENTION

Now the invention will be specifically described with reference to the attached drawings.

FIGS. 1 and 2 show the relation between the Si and Cr contents and wettability with molten Al when substrate steel sheets containing 0.045% C, 0.3% Mn, 0.022% P and 0.0095% S was pre-plated with an Fe-B alloy containing 0.008% B to various thicknesses or not pre-plated and hot-dip-coated with an Al coating bath containing 9% Si. The used substrate steel sheet was 50×150 mm. The steel sheets were annealed in a reducing atmosphere comprising 50% (by volume) $H_2$-$N_2$ having a dew point of −60° C. and hot-dip-coated in said bath at 670° C. for 2 seconds.

The obtained products were evaluated by the number of dewetted (non-coated) spots. The rating is as follows:

5: No dewetted spots observed

4: Up to than 5 dewetted spots less than 1 mm in diameter observed

3: More than 5 dewetted spots less than 1 mm in diameter observed

2: A plurality of dewetted spots less than 1 mm in diameter or spots larger than 1 mm in diameter observed 1: A plurality of dewetted spots larger than 1 mm in diameter observed As being apparent in FIGS. 1 and 2, when the Si content of the substrate is in excess of 0.3%, or the Cr content is in excess of 2.0%, the wettability with molten Al decreases and occurrence of dewetted spots increases with the increase of the contents of these elements if the substrate is not suitably pre-plated with Fe-B alloys.

In contrast, very good hot-dip Al-coating is effected when the steel substrate is suitably pre-plated with Fe-B alloys. This means that the process of the present invention is very suitable for steel substrates which contain 0.3% or more Si or 2% or more Cr.

FIGS. 1 and 2 teach that when the Si or Cr content increases, thicker Fe-B alloy plating is necessary. From the view point of economy and practical utility, however, a coating weight of 0.05~5 g/m$^2$ is suitable.

As seen in these drawings, even if the contents of Si and Cr in the substrate steel increase, good hot-dip coating is obtained by thickly pre-plating with an Fe-B alloy. However, if the contents of Si and Cr are in excess of 2.0% and 30% respectively, the workability of the steel per se is degraded, and, therefore, Si and Cr contents not in excess of these values are practically preferred.

FIG. 3 shows the relation between the B content in the Fe-B pre-plating and wettability with molten Al when an AISI409 stainless steel (Cr: 11.0%, Si: 0.6%) was electrolytically pre-plated with Fe-B alloys of various B contents to the thickness of 1.0 g/m$^2$. The criteria for evaluation of the wettability are the same as in the case of FIGS. 1 and 2.

As being apparent from this drawing, the wettability of steel substrates is improved when the substrate is pre-plated with an Fe-B alloy containing 0.001% or more B. However, the effect of the pre-plating saturates at the B content of 0.3%. Therefore, the B content in the Fe-B alloy is limited to 0.001~0.3%.

Although the above results are those obtained in the experiments with respect to hot-dip coating with Al, those skilled in the art will understand that similar or better results will be obtained with respect to Zn, which has better affinity to Fe. In fact, very good results are obtained as substantiated by working examples described below.

EXAMPLE 1

Hot-dip aluminum-coated steel sheets were prepared using 0.8 mm thick cold-rolled sheets of a SUS430 steel, which contains C: 0.06%, Si: 0.65%, Mn: 0.33%, P: 0.024%, S: 0.010%, Cr: 17.8% and inevitable impurities and Fe.

The above-mentioned substrate sheets were degreased by the conventional method and electrolytically plated with an Fe-B alloy using the plating solution under the plating conditions indicated in Table 1. The B content in the alloy and the thickness of the plating layer were controlled by modifying the amount of boric acid added to the plating solution and the plating time. For the purpose of comparison, some substrate sheets were pre-plated with Ni with the plating solution and under the conditions indicated in Table 1.

The thus pre-plated substrate sheets were preheated to 800° C. in an atmosphere comprising 50% (by volume) $H_2$-$N_2$ for 30 sec and, thereafter, dipped in an Al-8% Si bath for 2 seconds in the same atmosphere. Thus hot-dip aluminum coated steel sheets were obtained. The coating weight was 50 g/m$^2$ per side.

The thus obtained hot-dip aluminum-coated steel sheets were evaluated by counting the dewetted spots occurring in an area of 50 mm×100 mm in accordance with the above described criteria.

The hot-dip aluminum-coated steel sheets were bent to 2t according to the test method of JIS Z2248 and thereafter subjected to 3,000 cycles of the accelerated corrosion test based on JIS Z2371, wherein one cycle consisted of 3 hour salt water spraying and 1 hour of hot wind drying at 50° C.

The degree of corrosion was evaluated by the maximum depth of corrosion pits after corrosion products and the remaining coating plating layer were removed by dissolution.

TABLE 1

| | Fe-B Pre-Plating | | Ni Pre-Plating | |
|---|---|---|---|---|
| Compot. of Plating solution | Ferrous sulfate (heptahydrate) | 300 g/l | Ni chloride (hexahydrate) | 360 g/l |
| | Sodium sulfate | 70 g/l | Hydrochloric acid | 10 cc/l |
| | Tartaric acid | 1 g/l | | |
| | Boric acid | 5~50 g/l | | |
| Plating Condi'n | pH | 1.2~2.0 | pH | 1.2~1.8 |
| | Bath temp. | 50° C. | Bath temp. | 40° C. |
| | Current density | 50 A/dm$^2$ | Current density | 20 A/dm$^2$ |

The wettability of the substrate sheets and the corrosion resistance of the coated sheets of tested samples are summarized in Table 2.

Samples 1, 2, 5 and 7 are not products of the process of the present invention although they were pre-plated with Fe-B alloys. of these samples, Sample 1, 2 and 5 suffered from serious pitting penetrating the substrate sheets. Sample 7 was inferior in corrosion resistance to the products of the process of the present invention although it did not suffer penetration of the substrate. Samples 3, 4, 6, 8, 9 and 10, which were pre-plated with Fe-B alloys containing 0.001~0.3% of B in a thickness of 0.05~5 g/m$^2$ suffered only slight corrosion both in the flat portions and in the 2t bent portions. Samples 11 and 12, which were pre-plated with Ni, were inferior to the products of the process of the present invention in corrosion depth although occurrence of dewetted spots was prevented. Sample 13, which was not pre-plated, was obviously inferior in corrosion resistance.

EXAMPLE 2

Hot-dip zinc-coated and zinc-aluminum-alloy-coated steel sheets were prepared using 0.8 mm thick cold-rolled sheets of steels which contains Cr: 2~30%, C: 0.03%, Si: 0.38%, Mn: 0.27%, P: 0.017%, S: 0.010% and inevitable impurities and Fe.

The above-mentioned substrate sheets were degreased by the conventional method and electrolytically plated with Fe-B alloys using the plating solution under the plating conditions indicated in in the above Table 1. The B content in the alloys and the thickness of the plating layer were controlled by modifying the amount of boric acid to be added to the plating solution and the plating time. For the purpose of comparison, some substrate sheets were pre-plated with Ni using the plating solution under the conditions indicated in Table 1.

The thus pre-plated substrate sheets were preheated at 800° C. in an atmosphere comprising 50% (by volume) $H_2$-$N_2$ for 30 seconds and, thereafter, dipped in 0.18~55% Al-Zn baths for 2 seconds in the same atmosphere. Thus hot-dip zinc-coated an zinc-alunimum alloy-coated steel sheets were obtained. The coating weight was 50 g/m$^2$ per side.

The thus obtained coated steel sheets were evaluated by counting the dewetted spots occurring in an area of 50 mm×100 mm in accordance with the above described criteria.

The hot-dip zinc-coated zinc-aluminum-alloy-coated steel sheets were bent to 2t according to the test method of JIS Z2248 and thereafter subjected to 3,000 cycles of the accelerated corrosion test based on JIS Z2371, wherein a cycle consisted of 3 hour salt water spraying and 1 hour of hot wind drying at 50° C.

The degree of corrosion was evaluated by the maximum depth of corrosion pits in the substrate sheets after the corrosion products and the remaining coating and plating layers were removed by dissolution.

The results are summarized in Tables 3-1, 3-2 and 3-3. Samples 1, 2, 5, 14, 15, 18, 27, 28, 31, 40, 41, 44, 53, 54, 57, 66, 67, 70, 79, 80, 83, 92, 96, 105, 106 and 109 are not products of the process of the present invention although they were pre-plated. They suffered penetration of the substrate sheets. In the products of the process of the present invention, corrosion was slight both in the flat portions and the 2t bent portions.

In Samples 11, 12, 24, 25, 37, 38, 50, 51, 63, 64, 76, 77, 89, 90, 102, 103, 115 and 116, which were pre-plated with Ni, the corrosion depths in the substrate sheets were deeper than in the products of the present invention, although occurrence of dewetted spots was reduced as the thickness of the Ni pre-plating layer increased. In the case of the Ni-pre-plated and hot-dip Zn-coated steel sheets, the rate of corrosion of the zinc coating layer is markedly great and the corrosion depth in the substrate sheets was great as the result.

TABLE 2

| No | Fe-B alloy elect. plating | | Rating of coated sheets | Max. cor. depth (mm) | | Remarks |
|---|---|---|---|---|---|---|
| | Coating wt. (g/m$^2$) | B cont. (wt %) | | Flat part | 2t bent | |
| 1 | 0.02 | 0.060 | 1 | Penetration | Penetration | * |
| 2 | 0.06 | 0 | 1 | " | " | * |
| 3 | 0.07 | 0.002 | 3 | 0.23 | 0.30 | |
| 4 | 0.06 | 0.084 | 4 | 0.18 | 0.21 | |
| 5 | 0.64 | 0 | 2 | Penetration | Penetration | * |
| 6 | 0.65 | 0.003 | 4 | 0.19 | 0.25 | |
| 7 | 1.8 | 0 | 3 | 0.34 | 0.48 | * |
| 8 | 1.7 | 0.005 | 5 | 0.15 | 0.21 | |
| 9 | 1.7 | 0.11 | 5 | 0.14 | 0.19 | |
| 10 | 3.0 | 0.035 | 5 | 0.16 | 0.20 | |
| 11 | 0.5 (Ni electrolytic plating) | | 3 | 0.45 | 0.53 | * |
| 12 | 1.5 (Ni electrolytic plating) | | 5 | 0.38 | 0.43 | * |
| 13 | Without electrolytic plating | | 1 | Penetration | Penetration | * |

*Comparative example

TABLE 3

| No | Cr. cont. in steel (%) | Fe-B alloy elect. plating Coating wt. (g/m²) | B cont. (wt %) | Al content in Zn or Zn—Al bath (wt %) | Rating of coated sheets | Max. cor. depth (mm) Flat part | 2t bent | Remarks |
|---|---|---|---|---|---|---|---|---|
| 1 | 2.0 | 0.02 | 0.060 | 0.18 | 1 | Penetration | Penetration | * |
| 2 | 2.0 | 0.06 | 0 | 0.18 | 1 | " | " | * |
| 3 | 2.0 | 0.07 | 0.003 | 0.18 | 3 | 0.20 | 0.30 | |
| 4 | 2.0 | 0.06 | 0.079 | 0.18 | 4 | 0.18 | 0.25 | |
| 5 | 2.0 | 0.63 | 0 | 0.18 | 2 | Penetration | Penetration | * |
| 6 | 2.0 | 0.64 | 0.004 | 0.18 | 4 | 0.19 | 0.24 | |
| 7 | 2.0 | 1.65 | 0 | 0.18 | 3 | 0.37 | 0.51 | * |
| 8 | 2.0 | 1.63 | 0.006 | 0.18 | 5 | 0.12 | 0.18 | |
| 9 | 2.0 | 1.64 | 0.12 | 0.18 | 5 | 0.11 | 0.17 | |
| 10 | 2.0 | 3.00 | 0.045 | 0.18 | 5 | 0.13 | 0.16 | |
| 11 | 2.0 | 0.5 (Ni electrolytic plating) | | 0.18 | 3 | 0.40 | 0.51 | * |
| 12 | 2.0 | 1.5 (Ni electrolytic plating) | | 0.18 | 5 | 0.39 | 0.46 | * |
| 13 | 2.0 | Without electrolytic plating | | 0.18 | 1 | Penertation | Penetration | * |
| 14 | 2.0 | 0.02 | 0.060 | 4.0 | 1 | Penetration | Penetration | * |
| 15 | 2.0 | 0.06 | 0 | 4.0 | 1 | " | " | * |
| 16 | 2.0 | 0.07 | 0.003 | 4.0 | 3 | 0.19 | 0.28 | |
| 17 | 2.0 | 0.06 | 0.079 | 4.0 | 4 | 0.17 | 0.24 | |
| 18 | 2.0 | 0.63 | 0 | 4.0 | 2 | Penetration | Penetration | * |
| 19 | 2.0 | 0.64 | 0.004 | 4.0 | 4 | 0.18 | 0.22 | |
| 20 | 2.0 | 1.65 | 0 | 4.0 | 3 | 0.37 | 0.50 | * |
| 21 | 2.0 | 1.63 | 0.006 | 4.0 | 5 | 0.11 | 0.16 | |
| 22 | 2.0 | 1.64 | 0.12 | 4.0 | 5 | 0.10 | 0.17 | |
| 23 | 2.0 | 3.00 | 0.045 | 4.0 | 5 | 0.13 | 0.15 | |
| 24 | 2.0 | 0.5 (Ni electrolytic plating) | | 4.0 | 3 | 0.39 | 0.51 | * |
| 25 | 2.0 | 1.5 (Ni electrolytic plating) | | 4.0 | 5 | 0.36 | 0.47 | * |
| 26 | 2.0 | Without electrolytic plating | | 4.0 | 1 | Penetration | Penetration | * |
| 27 | 2.0 | 0.02 | 0.600 | 55.0 | 1 | Penetration | Penetration | * |
| 28 | 2.0 | 0.06 | 0 | 55.0 | 1 | " | " | * |
| 29 | 2.0 | 0.07 | 0.003 | 55.0 | 3 | 0.19 | 0.31 | |
| 30 | 2.0 | 0.06 | 0.079 | 55.0 | 4 | 0.19 | 0.24 | |
| 31 | 2.0 | 0.63 | 0 | 55.0 | 2 | Penetration | Penetration | * |
| 32 | 2.0 | 0.64 | 0.004 | 55.0 | 4 | 0.17 | 0.25 | |
| 33 | 2.0 | 1.65 | 0 | 55.0 | 3 | 0.38 | 0.49 | * |
| 34 | 2.0 | 1.63 | 0.006 | 55.0 | 5 | 0.12 | 0.16 | |
| 35 | 2.0 | 1.64 | 0.12 | 55.0 | 5 | 0.10 | 0.15 | |
| 36 | 2.0 | 3.00 | 0.045 | 55.0 | 5 | 0.12 | 0.17 | |
| 37 | 2.0 | 0.5 (Ni electrolytic plating) | | 55.0 | 3 | 0.37 | 0.55 | * |
| 38 | 2.0 | 1.5 (Ni electrolytic plating) | | 55.0 | 5 | 0.39 | 0.47 | * |
| 39 | 2.0 | Without electrolytic plating | | 55.0 | 1 | Penetration | Penetration | * |
| 40 | 11.0 | 0.02 | 0.062 | 0.18 | 1 | Penetration | Penetration | * |
| 41 | 11.0 | 0.06 | 0 | 0.18 | 1 | " | " | * |
| 42 | 11.0 | 0.06 | 0.003 | 0.18 | 3 | 0.18 | 0.28 | |
| 43 | 11.0 | 0.06 | 0.078 | 0.18 | 4 | 0.16 | 0.23 | |
| 44 | 11.0 | 0.63 | 0 | 0.13 | 2 | Penetration | Penetration | * |
| 45 | 11.0 | 0.64 | 0.004 | 0.18 | 4 | 0.16 | 0.22 | |
| 46 | 11.0 | 1.65 | 0 | 0.18 | 3 | 0.33 | 0.51 | * |
| 47 | 11.0 | 1.63 | 0.007 | 0.18 | 5 | 0.10 | 0.15 | |
| 48 | 11.0 | 1.64 | 0.12 | 0.18 | 5 | 0.09 | 0.14 | |
| 49 | 11.0 | 3.00 | 0.047 | 0.18 | 5 | 0.11 | 0.15 | |
| 50 | 11.0 | 0.5 (Ni electrolytic plating) | | 0.18 | 3 | 0.38 | 0.50 | * |
| 51 | 11.0 | 1.5 (Ni electrolytic plating) | | 0.18 | 5 | 0.38 | 0.45 | * |
| 52 | 11.0 | Without electrolytic plating | | 0.18 | 1 | Penetration | Penetration | * |
| 53 | 11.0 | 0.02 | 0.060 | 4.0 | 1 | Penetration | Penetration | * |
| 54 | 11.0 | 0.06 | 0 | 4.0 | 1 | " | " | * |
| 55 | 11.0 | 0.07 | 0.003 | 4.0 | 3 | 0.16 | 0.26 | |
| 56 | 11.0 | 0.06 | 0.079 | 4.0 | 4 | 0.15 | 0.24 | |
| 57 | 11.0 | 0.63 | 0 | 4.0 | 2 | Penetration | Penetration | * |
| 58 | 11.0 | 0.64 | 0.004 | 4.0 | 4 | 0.16 | 0.20 | |
| 59 | 11.0 | 1.65 | 0 | 4.0 | 3 | 0.36 | 0.50 | * |
| 60 | 11.0 | 1.63 | 0.006 | 4.0 | 5 | 0.10 | 0.14 | |
| 61 | 11.0 | 1.64 | 0.12 | 4.0 | 5 | 0.09 | 0.16 | |
| 62 | 11.0 | 3.00 | 0.045 | 4.0 | 5 | 0.12 | 0.14 | |
| 63 | 11.0 | 0.5 (Ni electrolytic plating) | | 4.0 | 3 | 0.38 | 0.50 | * |
| 64 | 11.0 | 1.5 (Ni electrolytic plating) | | 4.0 | 5 | 0.35 | 0.45 | * |
| 65 | 11.0 | Without electrolytic plating | | 4.0 | 1 | Penetration | Penetration | * |
| 66 | 11.0 | 0.02 | 0.060 | 55.0 | 1 | Penetration | Penetration | * |
| 67 | 11.0 | 0.06 | 0 | 55.0 | 1 | " | " | * |
| 68 | 11.0 | 0.07 | 0.003 | 55.0 | 3 | 0.18 | 0.31 | |
| 69 | 11.0 | 0.06 | 0.079 | 55.0 | 4 | 0.18 | 0.24 | |
| 70 | 11.0 | 0.63 | 0 | 55.0 | 2 | Penetration | Penetration | * |
| 71 | 11.0 | 0.64 | 0.004 | 55.0 | 4 | 0.16 | 0.24 | |
| 72 | 11.0 | 1.65 | 0 | 55.0 | 3 | 0.38 | 0.49 | * |
| 73 | 11.0 | 1.63 | 0.006 | 55.0 | 5 | 0.10 | 0.15 | |
| 74 | 11.0 | 1.64 | 0.12 | 55.0 | 5 | 0.08 | 0.14 | |
| 75 | 11.0 | 3.00 | 0.045 | 55.0 | 5 | 0.10 | 0.17 | |
| 76 | 11.0 | 0.5 (Ni electrolytic plating) | | 55.0 | 3 | 0.36 | 0.53 | * |
| 77 | 11.0 | 1.5 (Ni electrolytic plating) | | 55.0 | 5 | 0.38 | 0.45 | * |
| 78 | 11.0 | Without electrolytic plating | | 55.0 | 1 | Penetration | Penetration | * |
| 79 | 27.0 | 0.02 | 0.061 | 0.18 | 1 | Penetration | Penetration | * |

TABLE 3-continued

| No | Cr. cont. in steel (%) | Fe-B alloy elect. plating Coating wt. (g/m²) | Fe-B alloy elect. plating B cont. (wt %) | Al content in Zn or Zn—Al bath (wt %) | Rating of coated sheets | Max. cor. depth (mm) Flat part | Max. cor. depth (mm) 2t bent | Remarks |
|---|---|---|---|---|---|---|---|---|
| 80 | 27.0 | 0.07 | 0 | 0.18 | 1 | " | " | * |
| 81 | 27.0 | 0.07 | 0.003 | 0.18 | 3 | 0.15 | 0.20 | |
| 82 | 27.0 | 0.07 | 0.078 | 0.18 | 4 | 0.13 | 0.20 | |
| 83 | 27.0 | 0.65 | 0 | 0.18 | 2 | Penetration | Penetration | * |
| 84 | 27.0 | 0.65 | 0.005 | 0.18 | 4 | 0.14 | 0.21 | |
| 85 | 27.0 | 1.64 | 0 | 0.18 | 3 | 0.35 | 0.46 | * |
| 86 | 27.0 | 1.60 | 0.006 | 0.18 | 5 | 0.05 | 0.13 | |
| 87 | 27.0 | 1.60 | 0.13 | 0.18 | 5 | 0.04 | 0.12 | |
| 88 | 27.0 | 3.02 | 0.044 | 0.18 | 5 | 0.16 | 0.12 | |
| 89 | 27.0 | 0.5 (Ni electrolytic plating) | | 0.18 | 3 | 0.39 | 0.48 | * |
| 90 | 27.0 | 1.5 (Ni electrolytic plating) | | 0.18 | 5 | 0.39 | 0.46 | * |
| 91 | 27.0 | Without electrolytic plating | | 0.18 | 1 | Penetration | Penetration | * |
| 92 | 27.0 | 0.02 | 0.060 | 4.0 | 1 | Penetration | Penetration | * |
| 93 | 27.0 | 0.06 | 0 | 4.0 | 1 | " | " | * |
| 94 | 27.0 | 0.07 | 0.003 | 4.0 | 3 | 0.13 | 0.23 | |
| 95 | 27.0 | 0.06 | 0.079 | 4.0 | 4 | 0.11 | 0.20 | |
| 96 | 27.0 | 0.63 | 0 | 4.0 | 2 | Penetration | Penetration | * |
| 97 | 27.0 | 0.64 | 0.004 | 4.0 | 4 | 0.13 | 0.18 | |
| 98 | 27.0 | 1.65 | 0 | 4.0 | 3 | 0.34 | 0.44 | * |
| 99 | 27.0 | 1.63 | 0.006 | 4.0 | 5 | 0.07 | 0.13 | |
| 100 | 27.0 | 1.64 | 0.12 | 4.0 | 5 | 0.05 | 0.14 | |
| 101 | 27.0 | 3.00 | 0.045 | 4.0 | 5 | 0.08 | 0.11 | |
| 102 | 27.0 | 0.5 (Ni electrolytic plating) | | 4.0 | 3 | 0.37 | 0.50 | * |
| 103 | 27.0 | 1.5 (Ni electrolytic plating) | | 4.0 | 5 | 0.35 | 0.43 | * |
| 104 | 27.0 | Without electrolytic plating | | 4.0 | 1 | Penetration | Penetration | * |
| 105 | 27.0 | 0.02 | 0.600 | 55.0 | 1 | Penetration | Penetration | * |
| 106 | 27.0 | 0.06 | 0 | 55.0 | 1 | " | " | * |
| 107 | 27.0 | 0.07 | 0.003 | 55.0 | 3 | 0.12 | 0.23 | |
| 108 | 27.0 | 0.06 | 0.079 | 55.0 | 4 | 0.13 | 0.20 | |
| 109 | 27.0 | 0.63 | 0 | 55.0 | 2 | Penetration | Penetration | * |
| 110 | 27.0 | 0.64 | 0.004 | 55.0 | 4 | 0.12 | 0.25 | |
| 111 | 27.0 | 1.65 | 0 | 55.0 | 3 | 0.38 | 0.49 | * |
| 112 | 27.0 | 1.63 | 0.006 | 55.0 | 5 | 0.05 | 0.10 | |
| 113 | 27.0 | 1.64 | 0.12 | 55.0 | 5 | 0.04 | 0.10 | |
| 114 | 27.0 | 3.00 | 0.045 | 55.0 | 5 | 0.05 | 0.09 | |
| 115 | 27.0 | 0.5 (Ni electrolytic plating) | | 55.0 | 3 | 0.30 | 0.50 | * |
| 116 | 27.0 | 1.5 (Ni electrolytic plating) | | 55.0 | 5 | 0.33 | 0.38 | * |
| 117 | 27.0 | Without electrolytic plating | | 55.0 | 1 | Penetration | Penetration | * |

*Comparative example

We claim:

1. A process for preparing hot-dip-metal-coated steel sheets having excellent corrosion resistance comprising electrolytically plating steel sheets containing Si and/or Cr with an Fe-B alloy containing 0.001~0.3% by weight of B to a thickness of of 0.05~5 g/m² and thereafter hot-dip-coating the thus pre-plated substrate sheets with a molten bath of Zn, Al or Zn-Al alloy.

2. The process as recited in claim 1, wherein the substrate steel sheet is made of a steel which contains 0.3~2.0% Si and/or 2.0~30% Cr.

3. The process as recited in claim 2, wherein the substrate steel sheet is of a steel which contains 0.5~1.8% Si and/or 3.0~25% Cr.

4. The process as recited in any one of claims 1 to 3, wherein the Zn-Al alloy contains 2~65% Al.

5. The process as recited in claim 4, wherein the Zn-Al bath contains 3.5~60%.

6. The process as recited in any one of claims 1 to 3, wherein the Al Al bath contains 5~13% Si.

7. The process as recited in any one of claims 1 to 6, wherein the Fe-B pre-plating alloy contains 0.005~0.2% B.

* * * * *

UNITED STATES PATENT AND TRADEMARK OFFICE

CERTIFICATE OF CORRECTION

PATENT NO. : 4,913,785

DATED : April 3, 1990

INVENTOR(S) : Yukio Uchida, Yasunori Hattori, Yusuke Hirose, Nobuo Hatanaka and Nobuhiko Sakai

It is certified that error appears in the above-identified patent and that said Letters Patent is hereby corrected as shown below:

Column 1 Line 67 "mateials" should read --materials--.

Column 2 Line 38 delete "of" (second occurrence).

Column 2 Line 43 "specificaly" should read --specifically--.

Column 5 Line 25 "of" should read --Of--.

Column 6 Line 1 delete "in" (first occurrence).

Table 3 under B cont. (wt %) line 105 "0.600" should read --0.060--.

Claim 1 Line 45 Column 9 delete "of" (second occurrence).

Claim 6 Line 46 Column 10 delete "Al" (second occurrence).

Signed and Sealed this

Twenty-sixth Day of November, 1991

*Attest:*

HARRY F. MANBECK, JR.

*Attesting Officer*

*Commissioner of Patents and Trademarks*